US005192003A

United States Patent [19]

Billings

[11] Patent Number: 5,192,003

[45] Date of Patent: Mar. 9, 1993

[54] BEVERAGE BAR STRUCTURE AND SYSTEM

[76] Inventor: Chris L. Billings, 527 Miller Ave., Layton, Utah 84041

[21] Appl. No.: 820,197

[22] Filed: Jan. 13, 1992

[51] Int. Cl.[5] ..... B67D 5/56

[52] U.S. Cl. ..... 222/129.1; 222/146.6; 312/232

[58] Field of Search ..... 222/129.1-129.4, 222/144.5, 146.6, 108; 312/236, 401; 62/389, 400, 459, 463, 464

[56] References Cited

U.S. PATENT DOCUMENTS

| | | | |
|---|---|---|---|
| 2,750,076 | 6/1956 | Welty et al. | 222/129.1 |
| 3,331,536 | 7/1967 | DeLorenzo | 222/129.1 |
| 3,940,019 | 2/1976 | Kross et al. | 222/129.2 |
| 3,949,902 | 4/1976 | Thompson | 222/129.1 |
| 3,983,583 | 10/1976 | Herman et al. | 312/236 |

*Primary Examiner*—Andres Kashnikow
*Assistant Examiner*—Philippe Derakshani
*Attorney, Agent, or Firm*—M. Ralph Shaffer

[57] ABSTRACT

A beverage bar structure and system compromising essentially a self-contained unit which is releasably and selectively attachable to the ice chest of customary bar structure. The self contained unit includes a pumping unit provided a housing and, additionally, a beverage-container-receiving well upstanding from said pumping housing. Structure is provided for attaching the unit proximate the lip of the ice chest of the bar. The latter structure is designed to accommodate a variety of unit sizes relative to the dimensions of the ice chest. Juice and concentrate containers are coupled by suitable conduit to the unit for pumping thereby to a suitable beverage dispenser.

14 Claims, 4 Drawing Sheets

BEVERAGE BAR STRUCTURE AND SYSTEM

FIELD OF INVENTION

The present invention relates to beverage pumping units and dispensers and more particularly, to a new and improved, essentially self contained pumping unit with a container well which is attachable to the conventionally supplied ice chest of a bar, this for providing pumped liquids such as concentrates, fruit juices and the like proximate the ice chest and, more especially, proximate the dispenser area of the bar proper.

BACKGROUND AND BRIEF DESCRIPTION OF PRIOR ART

This invention pertains to auxiliary, essentially self-contained pumping structure which is useful for bars found in restaurants and other commercial establishments, stores such as health food stores, and even homes. For such bars it frequently become desirable to supply concentrates, fruit juices and other beverage liquids. In times past the fruit juices and concentrates are frequently stored in a separate room, and long hoses or conduit lines are used to conduct the beverage liquids from the storage area to the bar for dispensing to patrons. Storage of juice or other liquid containers on the countertop or on shelving at the bar takes up valued space and really is quite impractical. The long hose lines leading from the bar to remote beverage liquid storage areas, such as separate rooms, are likewise undesirable, and long liquid-conducting hoses may interfere with personnel travel and other functions. Bars are customarily provided with ice basins or ice chests proximate the counter area. It is a primary purpose of this invention to provide an essentially self-contained unit for convenient attachment to the ice chest so as to be readily available and proximate the counter area associated with such ice chest.

No prior art is known which teaches the concept of ready availability at a beverage bar of an essentially self-contained unit, with bottle storage well, attachable to and supported by the ice chest of the bar whereby to provide for convenient pumping of beverage juices located essentially thereat to the dispenser area of the bar.

BRIEF DESCRIPTION OF INVENTION

In the present invention a beverage liquid pumping unit is supplied and is attached or is made releasably attachable tc the front surface or front lip, relative to the server, of an ice chest provided with a bar. The attaching structure is designed to accommodate the attachment of a variety of sizes of pumping units relative to the size of the ice chest of a particular bar. Accordingly, a universal attachment is or can be provided. One method of attachment includes an inverted hook-like lip designed for positionment over the lip of an ice chest wall; another provides attachment to ice chest protrusions such as rivets, and so forth. In a preferred form of the invention the pumping unit is provided with structure providing an upstanding well for receiving bottles and other containers in a readily accessible upright position. The pumping unit herein is preferability power driven by pressurized carbon dioxide customarily available at the bar. However, the pumps can be electrically driven or even water driven if desired. A manifold, supplied the pumping unit receives the outlet lines from such unit and, additionally and separately, a pressurized water line. The output of the manifold includes a series of beverage fluid lines as well as the water line leading through and via a metal flex hose to the dispenser gun or other dispenser unit supplied the bar. Juice and concentrate containers are supplied proximate the pumping unit and include tubular conduit for conducting such beverage liquids directly to the pumping unit. Beverage selector buttons are supplied the dispenser for mixing water and a selected beverage liquid at the nozzle thereof for the patron.

In a preferred form of the invention the unit attached to the ice chest supplies a container well for bottles and the like proximate the ice chest and, in addition, a pumping unit and delivery system for beverage liquids whereby to supply the same under pressure to the bar dispenser.

OBJECTS

A principal object of the present invention is to provide a new and useful beverage.delivery system for a bar.

A further object is to provide a combination beverage liquid pumping unit and beverage container receiving well as a composite unit for attachment, generally releasable attachment, to the ice chest of a bar.

A further object is to provide liquid pumping system, essentially disposed in a self contained unit, which is readily attachable to the ice chest of a bar.

A further object is to provide a combination pumping unit and well structure useful at bars and attached to the ice chest thereof for facilitating the pumping of beverage liquids to the dispenser of the bar at and from a point proximate the ice chest of the same.

An additional object is to provide a pumping structure for beverage liquids utilizing, the ready access of pressurized carbon dioxide, proximately supplied the bar, for driving pumps of the unit so as to pump beverage liquids to and through a flex hose to a dispenser supplied the bar, for dispensing liquids in glasses and cups for customers and others.

BRIEF DESCRIPTION OF DRAWINGS

The present invention, both as to its organization and manner of operation will best be understood by reference to the following description, taken in conjunction with the following drawings, in which:

FIG. 9 is similar to FIG. 8, but illustrates one liquid selector button as being depressed.

DETAILED DESCRIPTION OF PREFERRED EMBODIMENTS

Figure 1:
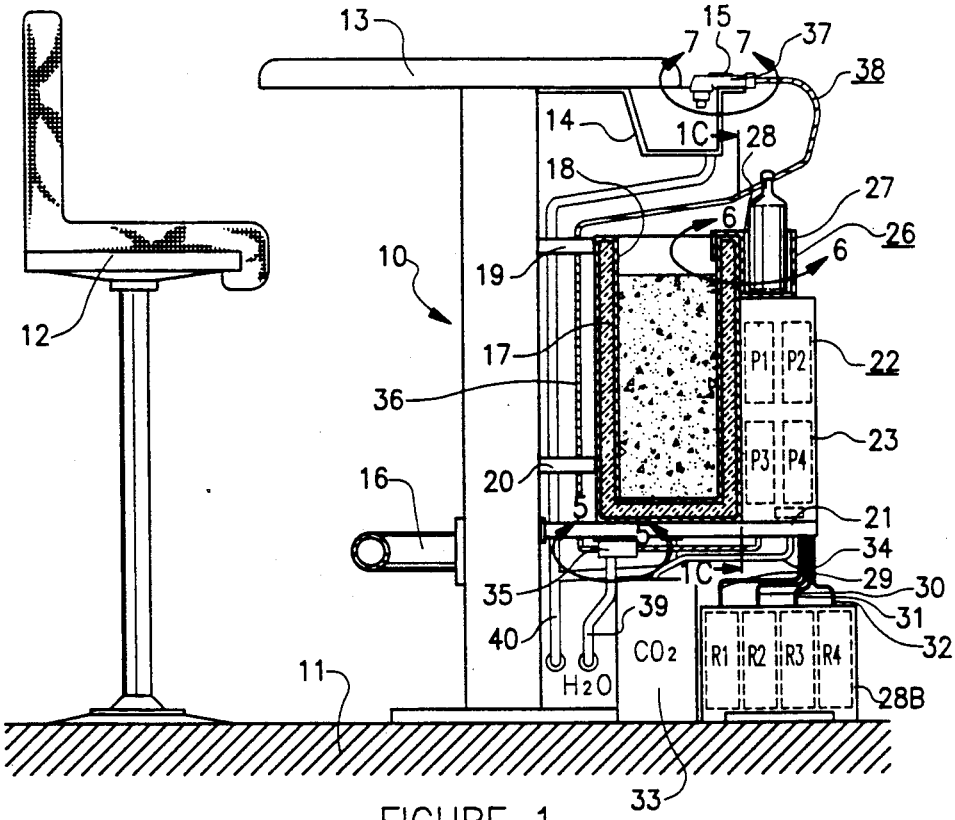
FIG. 1 is a side elevation, partially sectioned for convenience of illustration, of a bar incorporating the equipment of the present invention.

In FIG. 1 vertical support structure 10 is supported upon and anchored to floor 11. The latter also supports a stool structure 12 in conventional manner and of conventional form. Vertical support structure includes a bar top 13 To the latter is affixed a combination basin 14 and gun dispenser mount 15. The vertical support structure 10 may include a foot support rail 16 as may be desired. Ice chest 17 has insulated walls 18, may or may not include a top lid, and is preferably secured by brackets 19 and 20 to the vertical support structure 10. As an alternative, the ice chest 17 may simply rest upon a platform 21 that itself is secured in any conventional manner, not shown, to the vertical support structure 10. Pumping unit 22 is provided with a series of pumps P1, P2, P3 and P4, the same being enclosed within housing 23. Housing 23 is generally provided with an interior access door 24 that may be hinged or otherwise secured to the housing. The access door 24, if employed, covers access opening 25. It is important to note that the pumping unit is placed directly against the front side, relative to the server, of the ice chest, thus shielding the access opening from unauthorized personnel. The access opening is to provide for maintenance access to service men so that these may gain access to the pumps and their various conduits.

In a preferred form of the invention, the pumping unit 22 is provided with a container well 26 having sides 27 and, in a preferred form of the invention, an inverted, hook-shaped securement lip 28. The latter is for supporting the pumping unit with its associated container well 26 from a side of the ice chest. Well 26, of course, is designed for accommodating storage and ready access of beverage containers, bottles, glasses and the like. Particularly is the support lip 28 useful where a platform 21 is not deemed desirable or is used. Structure 28B may resemble a milk carton crate which is supported by floor 11 and which includes a series of beverage concentrate receptacles R1, R2, R3 and R4. Conduit 29–32 connect to the various receptacles R1–R4, respectively, and lead to pumps P1–P4 in the pumping unit 22. In one form of the invention a pressurized source of carbon-dioxide (CO2) is employed and includes an outlet conduit 34 leading to the several pumps P1–P4 to power these fluid driven pumps. In addition to these being CO2 driven, the several pumps P1–P4 can be electrically driven, powered by pressurized water, and so forth. Outlet conduit from the several pumps P1–P4 are coupled to a manifold 35, see FIG. 5. A flexible metallic cable 36 contains an inner conduit leading from the manifold as hereinafter described, which connect to the dispenser 37. The combination of manifold 35, metal flex hose 36, with dispenser 37 constitutes a dispenser system known in the industry as the Wunder-bar dispenser system 38. A pressurized source of water at 39 will be connected to the manifold 35; FIG. 1 also indicates a drain line 40 connected to the basin structure 14.

Figure 6:
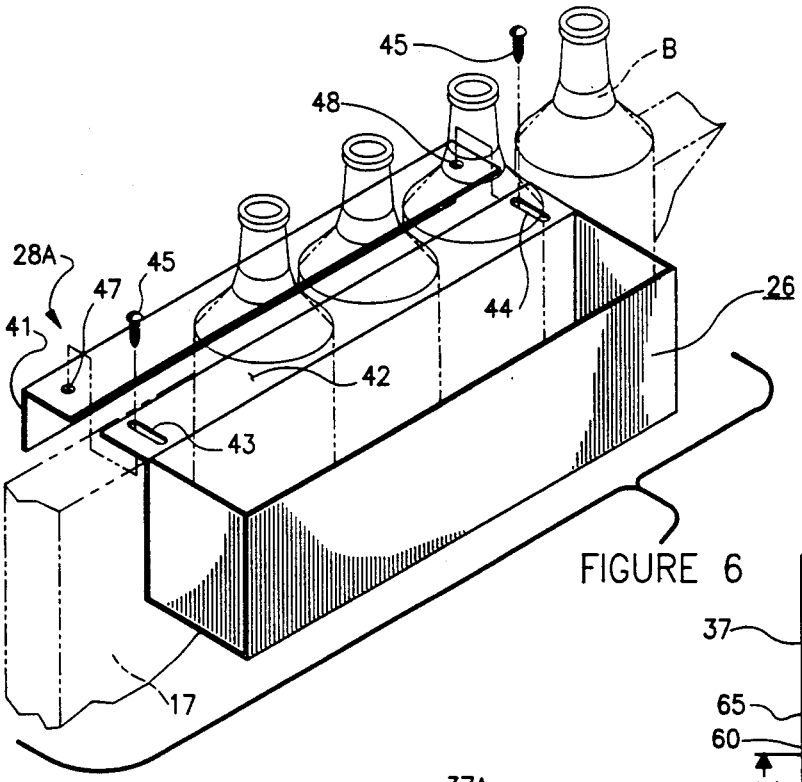
FIG. 6 is an enlarged perspective view, with the associated ice chest wall shown in phantom line, of the upper portion or well of the pumping unit being provided containers, also shown in phantom line; a flexible attachment structure is indicated whereby to accommodate the inverted suspension lip of the unit to the width of the chest wall.

FIG. 6 illustrates container well 27 26, having sides 27, see FIG. 1, as including a series of bottles B. Again, the container well, if used, with the pumping unit, not shown in FIG. 6, can be secured to a wall upper lip of the ice chest by the inverted lip 28 construction. An adjustable lip at 28A is indicated in FIG. 6 wherein the same simply includes an elongated angle member 41. Beverage container well 26 will include a flange 42 having a pair of slotted apertures 43 and 44 receiving screws 45 and 46. The latter will be threaded into threaded apertures 47 and 48 of the angle length 41. Accordingly, the slotted apertures 43 allow for adjustment so that the lip structure can be adjustable relative to the thickness of the wall of the ice chest at 17.

Figure 1A:
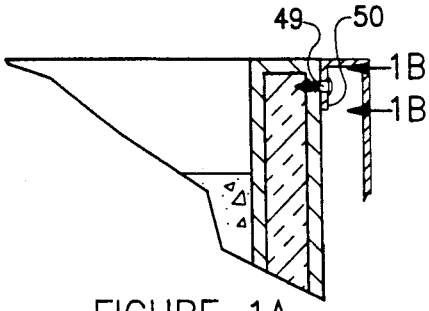
FIG. 1A is an enlarged fragmentary detail of alternate means of attachment of the pumping unit of the present invention to the ice chest of the bar.
Figure 1B:
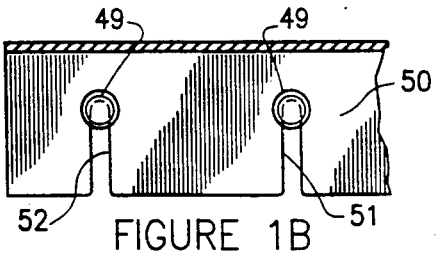
FIG. 1B is a view taken along the lines 1B—1B in FIG. 1A, illustrating the slotted connection of the structure to rivets or screws of the ice chest.
Figure 1C:
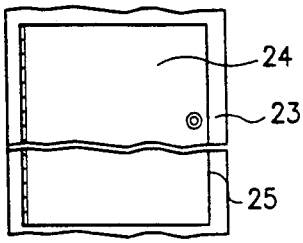
FIG. 1C is a fragmentary view taken along the line 1C—1C in FIG. 1 of that wall of the pumping unit proximate the ice chest, such wall being provided with an access opening and a permissibly included access door, and this to provide ready access for maintenance to the pumps and yet isolate such access from passersby when the pumping unit is attached to the ice chest wall.

FIG. 1A and FIG. 1B illustrate that the ice chest 17 may simply have a headed protrusion in the form of a rivet or screw 49. If desired, the container well and/or pumping unit may include in portion 50 vertical slots 51 and 52 which receive the headed protrusions 49; thus, the pumping unit structure may be supported simply by slot insertion of the pumping unit and/or container well structure relative to the protrusions 49.

Figure 10:
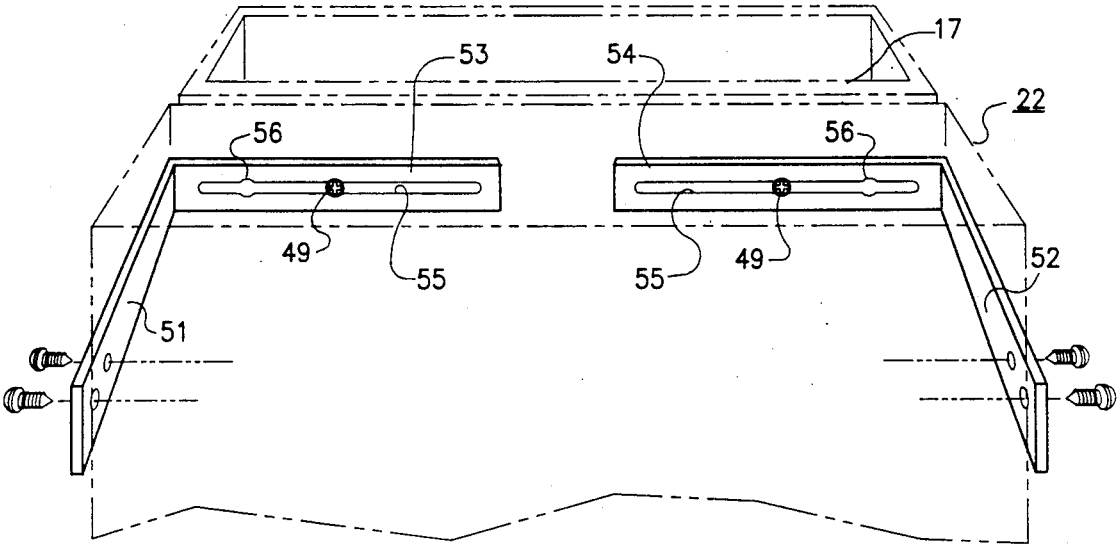
FIG. 10 is a perspective view of the pumping unit of the present invention wherein the same is provided with attachment structure for accommodating adjustable attachment to the rivets or other protrusions of the ice chest; this is performed as indicated so that the pumping unit of specific size may accommodate a variety of length sizes of the ice chest to which the unit is to be affixed.
Figure 11:
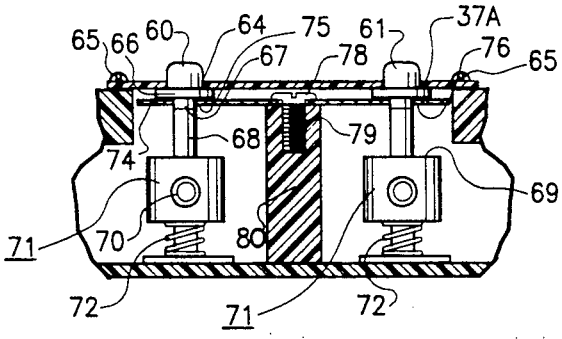
FIG. 11 is a transverse vertical section taken along the line 11—11 in FIG. 7.
Figure 11A:
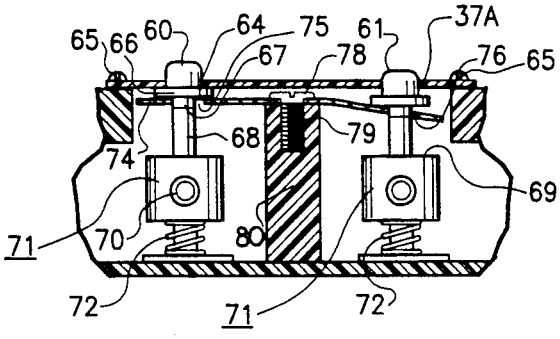
FIG. 11A is similar to FIG. 11, but illustrates one juice selector button depressed.

FIG. 10 illustrates another form of the invention where the container well and/or pumping unit is provided with a pair of slotted brackets 51 and 52, the same including slide bars 53 and 54. Each slide bar is provided with longitudinal slots 55 and protrusionreceiving apertures 56 which receives the rivets or other protrusions 49 from the "front" side of the ice chest, relative to the server; these are simply inserted in apertures 56 and permit the brackets 51 and 52 to be slid back and forth. This is for the purpose of accommodating various horizontal lengths of the pumping unit, so that the same, whatever its size, may be conveniently releasably attached to the ice chest at its supporting protrusions 49. Brackets 51 and 52 may be a riveted, bolted or otherwise secured to the pumping unit and/or container well, as may be desired.

Figure 2:
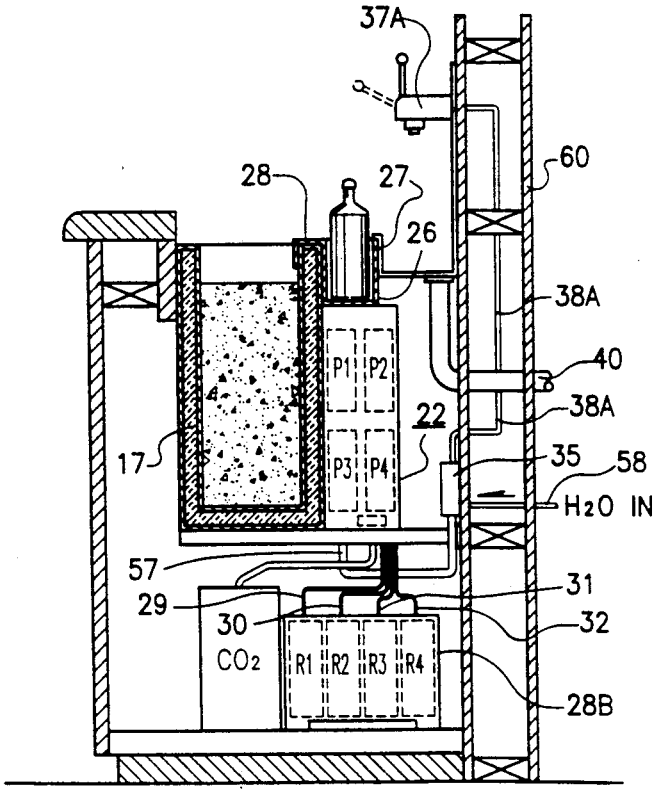
FIG. 2 is a side elevation, partially sectioned and similar to FIG. 1, wherein the invention is adapted for use with a customer actuated dispenser at a bar unit.

FIG. 2 illustrates another embodiment wherein the pumping unit with its container well, if employed, can be secured to the ice chest of a self serving unit. In this regard the pressurized carbon dioxide source is included, this together with the several concentrated or juice containers at the supply station having structure 28B. The individual containers or receptacles are again provided with tubes or conduit 29-32 which lead to pumps P1-P4 in pumping unit 22. The outlet conduit or tubes from pumps P1-P4 extend through the encapsulating hose 57, again, to manifold 35. Conduit 38A leads to the dispenser 37A of customary design for beverage self-service installations, for example. Pressurized water will be conducted via conduit 58 to the manifold 35. Structure 60 accommodates the mounting of the dispenser 37A as well as the other structure, as indicated. Again, the pumping unit is conveniently supported by the ice chest at 17 by the overhanging lip at 28.

Figure 3:
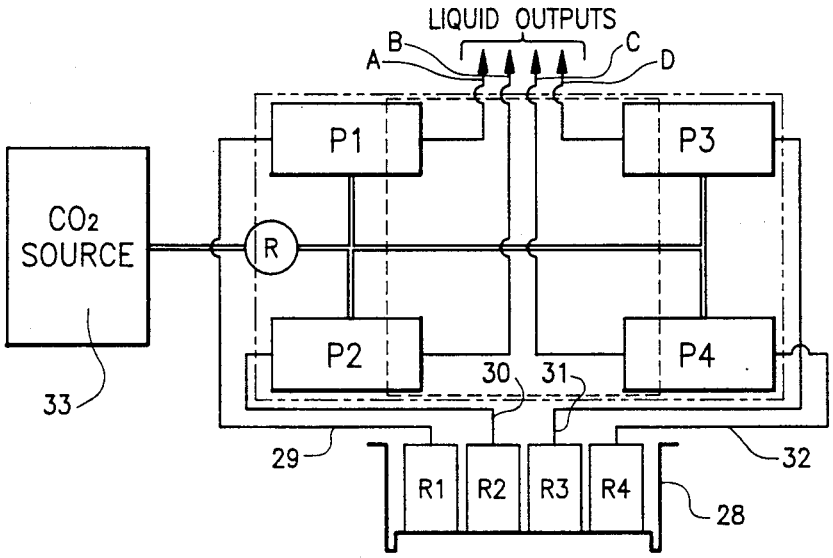
FIG. 3 is a schematic of the system utilized in the invention relative to the structure shown in FIG. 1 and FIG. 2.
Figure 4:
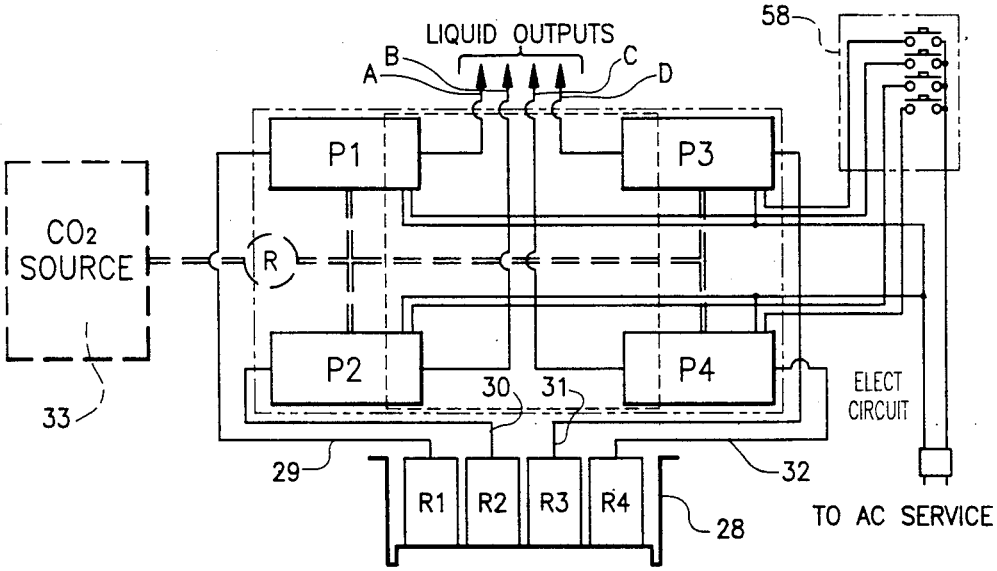
FIG. 4 illustrates that rather than using a pressurized carbon dioxide source as in FIG. 3, the several pumps in the pumping unit may be electrically driven as indicated; a pressurized carbon dioxide source is shown in dotted line indicating optional inclusion thereof in supplying carbonization to the liquids at the various pumps.

FIG. 3 illustrates in schematic form the driving by a pressurized carbon dioxide source 33 of the fluid driven pumps P1-P4. P1-P4 are standard off-the-shelf items in the industry and are sometimes known as Shur-flo Brix pumps. Of course, other types of pumps, such as electrically driven pumps and pumps driven by pressurized water, can also be employed. In any event, the input sides of the various pumps are supplied by juice or juice concentrate or other fluids from receptacles R1-R4 through leads 29-32 respectively. The carbon dioxide source operates the pumps such that their output size provide pressurized fluids at conduit A-D. As may be desired, regulator R maybe used to regulate the applied pressure of the carbon dioxide, see FIG. 3. Another embodiment of the invention is shown in FIG. 4 wherein an electrical circuit is provided, including switch box 58; push button switches thereof are shown and are coupled to and power the respective pumps P1-P4. The fluid inlets from the various fluid concentrate receptacles R1-R4, for example, connect as before to the input driven sides of the pump P1-P4, see FIG. 3. Optionally there may be included a carbon dioxide source with a regulator R for supplying carbonization to the respective fluids which are supplied the pumps. Pressurized liquid outputs again are derived at conduits A-D in FIG. 4.

Figure 5:
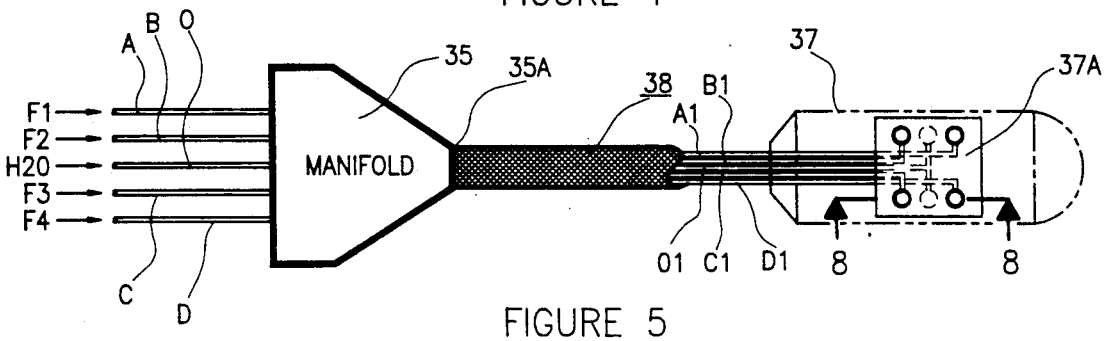
FIG. 5 is a top plan of a portion of the system including the manifold, its inlet to the conduit, and the metal flex hose containing the outlet to lead to the dispenser of the system.
Figure 7:
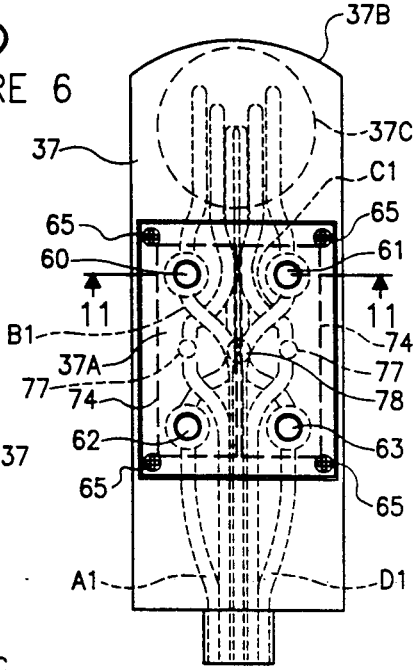
FIG. 7 is top plan view of one type of dispenser head or gun that may be used with the system.
Figure 8A:
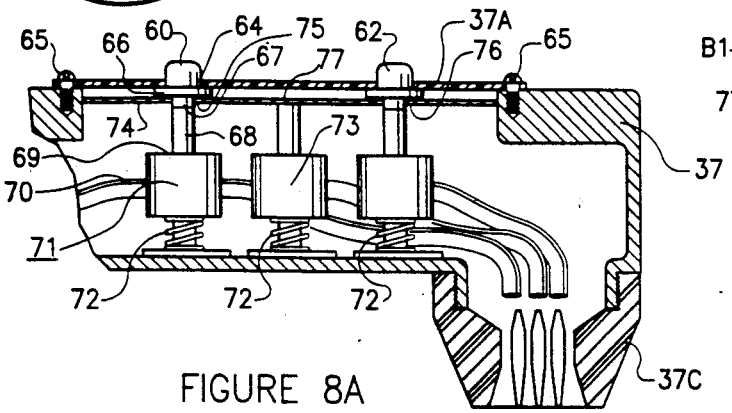
FIG. 8 is a longitudinal section of the dispenser shown in FIG. 5 and is taken along the line 8—8 in FIG. 5.
Figure 8B:
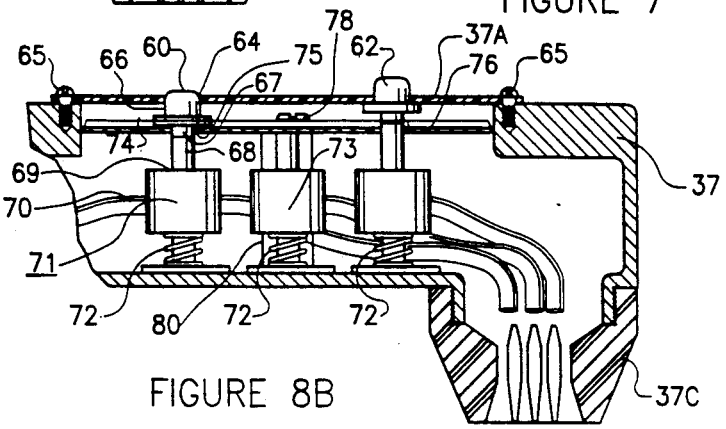

FIG. 5 illustrates in plan a schematic form the manifold 35 having the various fluids F1-F4 conducted by conduits A-D to the input side of the manifold. Also supplied will be a water source feeding conduit O from conduit 39 in FIG. 1 for example. In FIG. 7, cover plate 37A is indicated as installed. To the dispenser at its inner tubes or passageways are coupled with the various tubes A1-D1 and also O1 which lead from the output side 35A of the manifold. The structure in FIG. 5 is known in general in the industry as a Wunder-Bar dispenser, and is a standard off-the-shelf assembly.

In operation, the system is turned on such that pressurized carbon dioxide or another driving power source is supplied individual pumps P1-P4. The pumps draw liquid from the receptacles R1-R4 and supply a selected liquid, as selected at the dispenser 37, for example, for mixture with water and expulsion from the dispenser or gun into the glass or cup of the user.

In FIGS. 7-9, 11 and 11A the dispenser is shown to have a series of juice or beverage selector buttons 60-63 which protrude through holes 64 in cover plate 37A. The latter, of course, is releasably secured to the dispenser body 37B by screws 65. The selector buttons 60-63 may include dogs, collars or other structure 66 to prevent the inadvertent fall-out of the buttons should the dispenser gun be inverted. Each of the buttons includes a depending stem 67 engaging valve stem 68 of respective juice or concentrate selector valves 69. Plural passageways 70 are normally closed by the respective valves, and the valves 71 themselves are each spring biased at 72. Respective valves for each juice or concentrate are provided. Pairs of valves on either side of the dispenser are supplied with water flow valves 73 in essentially identical form. Representative actuator plates 74 on either side of the dispenser unit include apertures 75 and 76 for receipt of the respective push button stems 67. However, the plate is solid, i.e. blinded off relative to the water valve stem position at 77. Accordingly, depression of either button on one side of the dispenser gun will depress the plate, by virtue of the push button shoulder or collar applying pressure on the upper surface of the plate, and this will automatically produce a depression of the water conduction valve 73 at its stem. Accordingly, but a single water valve need be employed for each pair of separate juice selector buttons. The same structure will be true on both sides of the dispenser unit. The actuator plates themselves operate in a sense as wings of a butterfly and can be flexible, with the interior edges thereof being essentially retained in place by screw 78 and its threaded insertion into tapped hole 79 of upstanding rib 80 of the dispenser body 37B. The water paths relative to the respective juice selector valves can be joined if desired, this to mix at the nozzle extremity 37C with the respective juices respectively selected and passed thereto.

In operation, thus, once the system is turned on, the user will depress the particular juice desired, and that juice or concentrate with the water of the associated water valve will automatically pass to and be mixed at the nozzle 37C for dispensing to a customer.

It is seen that the present system and structure provide means for supplying desired beverages at a desired location rather than pumping juices from separate storage rooms, and the like, the unit can simply be supported by the customary ice chest used with the bar.

While particular embodiments have been shown and described, it will be obvious to those skilled in the art that various changes and modifications may be made without departing from the essential aspects of this invention and, therefore, the aim in the appended claims is to cover all such changes and modifications as are truly contemplated by the present invention.

I claim:

1. A beverage bar structure including, in combination, a bar provided with a bar top and vertical support structure secured to and supporting said bar top, said support structure being provided with an ice chest, a beverage fluid pumping unit separate from but releasably attached externally to said ice chest and having inlet and outlet portions, said pumping unit having means for effecting such releasable attachment, means coupled to said pumping unit for powering said pumping unit, a series of beverage fluid containers fluidcoupled to said inlet portion of said pumping unit, a water source, and a delivery system coupled to said outlet portion of said beverage fluid pumping unit and also to said water source, said delivery system including a manually actuatable nozzle means for selectively expelling a selected beverage at said bar top.

2. The structure of claim 1 wherein said pumping unit includes an enclosure having a maintenance access opening next to said ice chest.

3. A beverage bar structure including, in combination, a bar provided with a bar top and vertical support structure secured to and supporting said bar top, said support structure being provided with an ice chest, a beverage fluid pumping unit releasably attached to said ice chest and having inlet and outlet portions, means coupled to said pumping unit for powering said pumping unit, a series of beverage fluid containers fluid-coupled to said inlet portion of said pumping unit, a water source, and a delivery system coupled to said outlet portion of said beverage fluid pumping unit and also to said water source, said delivery system including a manually actuatable nozzle means for selectively expelling a selected beverage at said bar top, and wherein said pumping unit includes an enclosure having an access door which is positioned against and covered by said ice chest.

4. The structure of claim 1 wherein said beverage fluid pumping unit is detechable from said ice chest and includes a housing, pumps disposed within said housing, and a beverage container well upstanding from said housing.

5. A beverage bar structure including, in combination, a bar provided with a bar top and vertical support structure secured to and supporting said bar top, said support structure being provided with an ice chest, a beverage fluid pumping unit releasably attached to said ice chest and having inlet and outlet portions, means coupled to said pumping unit for powering said pumping unit, a series of beverage fluid containers fluid-coupled to said inlet portion of said pumping unit, a water source, and a delivery system coupled to said outlet portion of said beverage fluid pumping unit and also to said water source, said delivery system including a manually actuatable nozzle means for selectively expelling a selected beverage at said bar top, and wherein said ice chest includes front headed attachment protrusions, said pumping unit being provided with apertures selectively engaging said protrusions for supporting said pumping unit from said ice chest.

6. The structure of claim 1 wherein said ice chest includes front headed attachment protrusions, said pumping unit being provided with means for releasably attaching said pumping unit to said ice chest.

7. A beverage bar structure including, in combination, a bar provided with a bar top and vertical support structure secured to and supporting said bar top, said support structure being provided with an ice chest, a beverage fluid pumping unit releasably attached to said ice chest and having inlet and outlet portions, means coupled to said pumping unit for powering said pumping unit, a series of beverage fluid containers fluid-coupled to said inlet portion of said pumping unit, a water source, and a delivery system coupled to said outlet portion of said beverage fluid pumping unit and also to said water source, said delivery system including a manually actuatable nozzle means for selectively expelling a selected beverage at said bar top, and wherein said ice chest includes front headed attachment protrusions, said pumping unit being provided with slide bars having longitudinal slots and protrusion head slot openings releasably secured to and over said protrusions, whereby to accommodate the mounting of various sizes of pumping units for releasable attachment to said ice chest.

8. In combination, an ice chest proximate a beverage consumption station, a separate pumping unit releasably attached to said ice chest and having means for effecting this releasable attachment, said pumping unit being provided with means for supplying beverage liquid to said unit, and a delivery system coupled to said pumping unit for expelling a selected beverage for consumption for a user who may require external ice elements contained in said ice chest.

9. The combination of claim 8 wherein said pumping unit has an access opening positioned against said ice chest.

10. In combination, an ice chest proximate a beverage consumption station, a pumping unit attached to said ice chest, said pumping unit being provided with means for supplying beverage liquid to said unit, and a delivery system coupled to said pumping unit for expelling a selected beverage for consumption for a user who may require external ice elements contained in said ice chest, and wherein a beverage container well structure is provided and is upstanding from said pumping unit.

11. In combination, an ice chest proximate a beverage consumption station, a pumping unit attached to said ice chest, said pumping unit being provided with means for supplying beverage liquid to said unit, and a delivery system coupled to said pumping unit for expelling a selected beverage for consumption for a user who may require external ice elements contained in said ice chest, and wherein said pumping unit is provided with means for securing said pumping unit to said ice chest for varying sizes of such ice chest.

12. The combination of claim 8 wherein said ice chest supportingly suspends said pumping unit above any primary support level.

13. In combination, a beverage dispenser system, a pumping unit coupled to said beverage dispenser system for delivering pressured beverage liquids to said beverage dispenser system, a series of beverage liquid supplies coupled to said pumping unit to be pumped by said pumping unit, a container well upstanding from said pumping unit, and an ice chest releasably supporting said pumping unit and container well.

14. In combination, a beverage dispenser system, a pumping unit coupled to said beverage dispenser system for delivering pressured beverage liquids to said beverage dispenser system, a series of beverage liquid supplies coupled to said pumping unit to be pumped by said pumping unit, a container well upstanding from said pumping unit, and an ice chest releasably supporting said pumping unit and container well, and wherein said pumping unit is provided with a pump-driving, pressured carbon-dioxide supply.

* * * * *